US008745931B2

(12) United States Patent
Hutter

(10) Patent No.: US 8,745,931 B2
(45) Date of Patent: Jun. 10, 2014

(54) METHOD OF ASSEMBLING EMERGENCY SHELTER PANELS INCLUDING A BED PLATFORM

(76) Inventor: Gerhard P Hutter, Bedford, NY (US)

( * ) Notice: Subject to any disclaimer, the term of this patent is extended or adjusted under 35 U.S.C. 154(b) by 456 days.

(21) Appl. No.: 12/931,494

(22) Filed: Feb. 1, 2011

(65) Prior Publication Data

US 2011/0185644 A1 Aug. 4, 2011

Related U.S. Application Data

(60) Provisional application No. 61/337,186, filed on Feb. 1, 2010.

(51) Int. Cl.
*E04B 1/35* (2006.01)
*E04B 1/343* (2006.01)

(52) U.S. Cl.
CPC ..... *E04B 1/34384* (2013.01); *E04B 1/355* (2013.01)
USPC ..... 52/79.5; 52/79.9

(58) Field of Classification Search
USPC ..... 52/79.1, 79.5, 79.9, 173.3
See application file for complete search history.

(56) References Cited

U.S. PATENT DOCUMENTS

| | | | | |
|---|---|---|---|---|
| 3,387,733 | A * | 6/1968 | Field | 52/64 |
| 3,818,653 | A * | 6/1974 | Williams | 52/79.1 |
| 3,923,134 | A * | 12/1975 | Rezazadeh | 52/79.1 |
| 4,272,930 | A * | 6/1981 | Foster | 52/79.1 |
| 4,922,084 | A * | 5/1990 | Hutter | 219/549 |
| 5,265,385 | A * | 11/1993 | Smith et al. | 52/79.5 |
| 5,657,583 | A * | 8/1997 | Tennant | 52/79.5 |
| 6,341,451 | B1 * | 1/2002 | Morton, Sr. | 52/79.1 |
| 8,381,455 | B2 * | 2/2013 | Schooley | 52/79.9 |
| 8,429,858 | B1 * | 4/2013 | Robinson et al. | 52/79.5 |

* cited by examiner

*Primary Examiner* — Mark Wendell
*Assistant Examiner* — Matthew J Smith
(74) *Attorney, Agent, or Firm* — Joseph M. Fowler

(57) ABSTRACT

An emergency shelter structure is disclosed for use where people are displaced from their homes as the result of some catastrophe. The inventive shelter can be erected entirely without hand tools or power tools in less than 20 minutes. It is comprised of plastic panels which are joined together using push anchors, fasteners which permit rapid and permanent engagement of adjoining panels. Bed platforms are included as part of the assembly. In advanced embodiments, solar arrays are provided for harvesting solar energy for use as electricity and uni-directional heating apparatus is molded into the floor panel.

3 Claims, 3 Drawing Sheets

FIG. 3
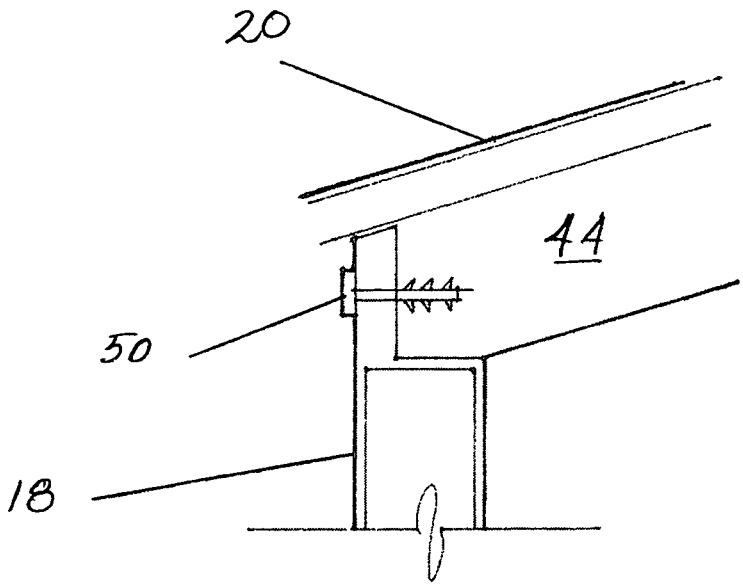
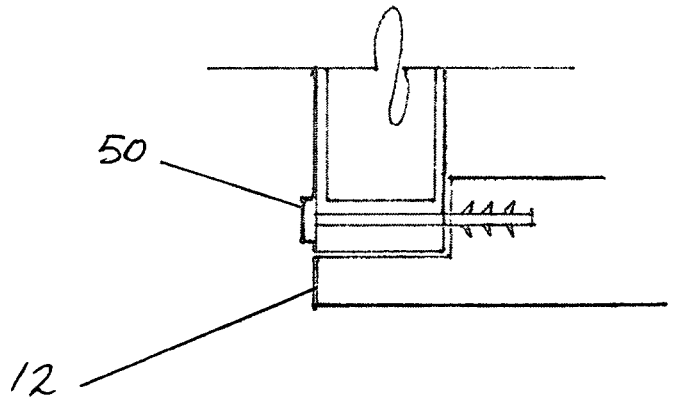
FIG. 4

METHOD OF ASSEMBLING EMERGENCY SHELTER PANELS INCLUDING A BED PLATFORM

CROSS REFERENCE TO RELATED APPLICATIONS

The present application claims the priority of U.S. Provisional Patent Application Ser. No. 61/337,186, filed Feb. 1, 2010, entitled "EMERGENCY SHELTER."

STATEMENT REGARDING FEDERALLY SPONSORED RESEARCH AND DEVELOPMENT

Not Applicable

REFERENCE TO SEQUENCE LISTING, A TABLE, OR COMPUTER PROGRAM LISTING COMPACT DISC APPENDIX

Not Applicable

BACKGROUND OF THE INVENTION

1. Field of the Invention

The present invention relates to emergency shelters and specifically to emergency shelters provided to relieve suffering as a result of large scale disasters where many people are displaced from their homes. More specifically, the present invention discloses construction of short term sleeping quarters using pre-formed plastic panels enabling displaced persons to survive more safely and comfortably than they would if they were using more conventional facilities.

2. Description of the Prior Art

Typically, relief agencies and governments turn to tent erection as the primary solution to short term housing even though the limitations and shortcomings of tents and tent-like shelters are well known. Tents of the kind provided to refugees offer little protection from temperature extremes in cold or very hot climates. The internal support structure of a tent can be difficult for ordinary, unskilled persons to assemble properly without training. Tents usually have dirt floors which can be wet and unsanitary and a haven for vermin, insects and even unwanted reptiles. Tents can also be expensive to manufacture depending upon the fabric used and the complexity of the mechanical structure needed to keep them up. Therefore many shelters and alternative dwelling units have been invented or proposed but have not been successfully commercialized. Cost is a major consideration and there is reluctance on the part of decision makers to depart from tents as a well known palliative. Some examples of more recent prior art follows beginning with the earliest chronologically.

A first example is U.S. Pat. No. 4,621,467, issued to Golden, which describes a system for constructing buildings using plastic panels to make emergency structures of unusual shape—rhombic triacontahedral buildings—featuring special hollow edge connectors. The hollow connectors have extruded profiles which fit along the edge of each panel connecting one to another. The instant invention uses a different means of fastening panels altogether as each panel is joined directly to an adjacent panel to form a simple rectangular structure.

A second example, more akin in appearance to the instant invention, is U.S. Pat. No. 5,083,410 to Watson, for a "System for Construction of Emergency Housing". Watson's rectangular construction is made of metal and uses a number of different pre-formed metal channels and common fastening components. Watson envisions an emergency shelter which can be converted into a permanent habitation. Except for initial appearance, the Watson structure is quite different in scope and manufacture from that offered here as an inventive solution.

U.S. Pat. No. 5,184,436 issued to Sadler discloses a portable utility structure which, in its preferred form, comprises two specially fabricated boards. One board can be folded down along hinged axes to form the top and sides of the shed and the second board can be folded up forming front and back panels. Interlocking tabs connect the top board structure to the bottom part. This appears analogous to various constructions of cardboard boxes and differs markedly from the instant invention which uses primarily plastic panels and entirely different connecting devices.

U.S. Pat. No. 5,319,904 awarded to Pascoe describes a prefabricated modular building formed from plastic interlocking panels. The panels are configured to form a cone-like structure which helps it resist extreme climatic wind forces and other harsh environmental hazards. It is a much more costly and sturdy structure than the current invention as it is intended to last much longer as a habitation, and even, as inventor Pascoe suggests, function as a hazardous waste storage facility.

U.S. Pat. No. 5,447,000 to Larsen discloses a system which uses plastic panels to partition the interior of standard intermodal freight containers. These containers are commonly used throughout the world and could be converted to emergency housing relatively quickly using pre-fabricated panels and cam-based connectors. While such an idea may have merit for longer term use as habitations for displaced people, they would be impractical to use in many disaster situations as the cost, availability and difficulties associated with converting great numbers of units and then transporting such large structures to remote areas poses huge logistical problems. The present invention addresses the more immediate need for fast and inexpensively manufactured habitations.

U.S. Pat. No. 5,771,639 issued to Wood discloses a polygonal structure put together with panels hinged to one another. Pulling on ropes or tensioning lines from opposite sides allows the structure to change from a group of stacked panels into a three dimensional polygonal structure. The present invention is delivered as a group of stacked panels, however, the method of assembly and the design of the shelter are, as will be shown herein, plainly a departure from the Wood disclosure.

Helin, WIPO Patent Application WO/2000/066846, discloses a house for temporary erection comprised of a plurality of plastic panel elements that are arranged in three layers. This design emphasizes the greater volume of inside space created by having an additional layer of ceiling panels. Of necessity, more panel elements are required in Helin's survival house than the simpler design employed in the present invention.

Linares, in U.S. Patent Application 2007/0074462 A1, discloses a modularizable and assembleable housing structure that emphasizes the use of powder impression molded construction. While some embodiments appear similar to the instant invention, the structure of Linares is different in manufacture, more costly and complicated and is intended to serve as permanent as opposed to temporary housing.

Similarly, Day, in U.S. Patent Application 2008/0263968, shows a structure built from a "kit" containing all the requisite components including toilet facilities, air conditioning and apparatus suitable for a housing unit in a society with a developed infrastructure. The instant invention, however, is only intended for temporary use in places where there is little or no functioning water or electricity infrastructure.

Finally, Esposito, in two U.S. Pat. Applications 2009/0223143 and 2009/0223144, discloses new variations on the use of intermodal containers for housing. These containers are designed for long term habitation unlike the present invention which is intended only for temporary use, at most, perhaps, a six month duration.

While there have been many prior attempts to address the need for better emergency shelters, the present invention removes the principal impediments to adoption of a newer design, namely, by providing a design that has lower manufacturing costs, lower costs of transportation and extreme ease of assembly. It is exceedingly important that emergency shelters be easy to assemble on site wherever they may be needed by people who may be under a great deal of stress. Accordingly, an object of this invention is to provide an emergency shelter which is lightweight, easily transported using conventional means, and can be erected quickly and easily without tools. Another object of this invention is to provide an emergency shelter which is more durable, safe and comfortable than conventional tents which are usually supplied as a first response to calls for emergency shelters.

A further object of this invention is to provide an emergency shelter capable of shielding displaced persons from the debilitating effects of exposure to the natural elements and can serve as a temporary replacement dwelling for two persons though capable of being extended modularly into a larger habitat.

A further object of the invention is to provide a shelter which is constructed primarily of plastic panels, securely packaged and capable of being air-dropped by parachute to remote locations. Still another object of this invention, in an advanced embodiment, is to provide a fully operable emergency shelter equipped with uni-directional heating apparatus (as described in U.S. Pat. No. 4,922,084) located within the floor panel and solar generating power means normally supplied and located in the roof.

A still further object of this invention is to provide an emergency shelter composed of easily recyclable materials.

SUMMARY OF THE PRESENT INVENTION

The present invention discloses a novel and non-obvious assembly for use as an emergency shelter. In one embodiment, the inventive shelter is assembled from eight (8) plastic composite hollow-filled panels as sub-assemblies. Six (6) hollow-filled panel sub-assemblies form an exterior structure and two (2) bed platform panel sub-assemblies form interior components. Each component or sub-assembly is comprised mainly of a plastic polymerized panel shell with a hollow interior. At least a portion of the interior shell of each panel is filled with cellular or composite material. The panels, referred to herein also as sub-assemblies, or, panel sub-assemblies, have been pre-formed with holes or apertures and relieved portions for very fast assembly in the field by untrained people without the benefit of hand tools or power tools. Four (4) exterior panels or sub-assemblies are raised into an upright position to form the walls of the structure, and one wall panel contains a window and a doorway with a door hingedly affixed. A floor panel sub-assembly and a roof panel sub-assembly together with four wall sub-assemblies form the completed exterior structure. The inventive emergency shelter is portable and assembleable on the site where it is needed. It is delivered to the site in pre-assembled form. Normally, the panel sub-assemblies are stacked on a pallet in "knocked down" form. Very fast assembly of the emergency shelter structure from the pre-assembled form to a fully assembled three dimensional form is accomplished using "push anchors". Push anchors are fasteners that can be inserted manually and pushed into pre-existing holes in the panels joining adjacent panels together permanently. Panel fastening means incorporating wall or "push" anchors of the type shown in U.S. Pat. No. 4,633,640 and in U.S. Pat. Nos. 4,963,051 and 5,088,851 permit very rapid assembly of adjacent panels. Push anchors of this type have pivotable, triangular-shaped gripping members which will engage the internal foam or other composite medium inside the panel sub-assemblies. Holes are pre-formed or drilled in the panels to accept the insertion of the push anchors. It has been demonstrated that the entire emergency shelter can be erected by two people in 10 minutes or less after opening the packaging on the pallet containing the panel sub-assemblies. In more advanced embodiments, not illustrated in the accompanying drawings, the roof panel carries arrays of solar cells for converting radiant energy into electricity. In other embodiments, floor heating apparatus are embedded into the floor panel. Additionally, packaging used to contain a shelter assembly while it is being transported can be used to anchor it more firmly in its fully assembled location.

BRIEF DESCRIPTION OF THE DRAWINGS

Drawings are provided which illustrate and clarify inventive aspects of the emergency shelter as described in the Detailed Description which follows. Reference numerals in the drawings which refer to similar parts throughout the various views have similar numbers. It should be understood, however, that the invention is not limited to the embodiments illustrated by these Figures. The drawings, briefly described, are as follows:

FIG. 3 is a elevation detail in cross-section of a wall panel connected to the roof panel assembly by means of a fully inserted push anchor.

FIG. 4 is an elevation detail in cross-section showing how a vertical panel is connected to the floor platform by means of a fully inserted push anchor.

DETAILED DESCRIPTION OF PREFERRED EMBODIMENTS

Figure 1:
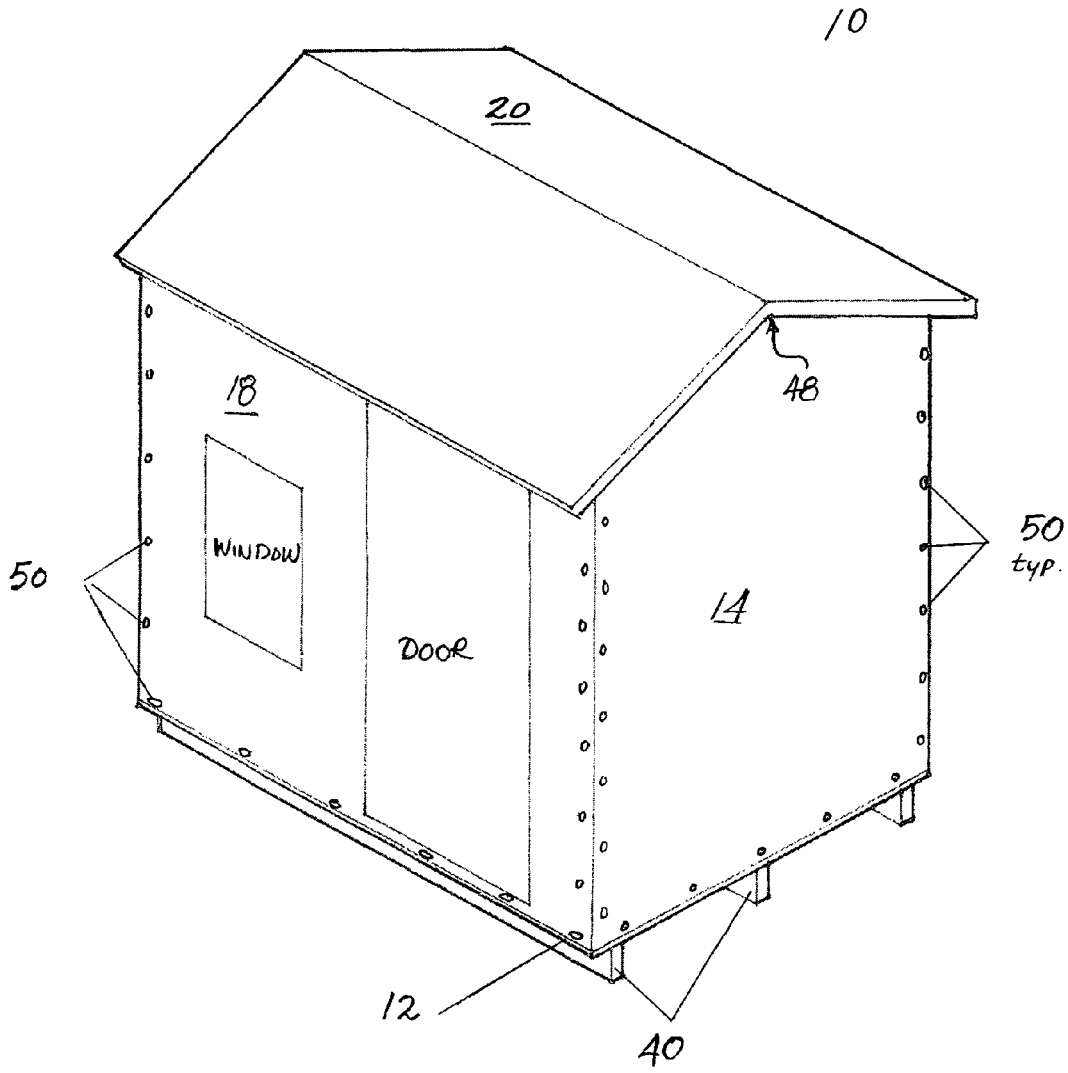
FIG. 1 is a perspective view from a front corner of the embodiment of an assembled emergency shelter unit.
Figure 2:
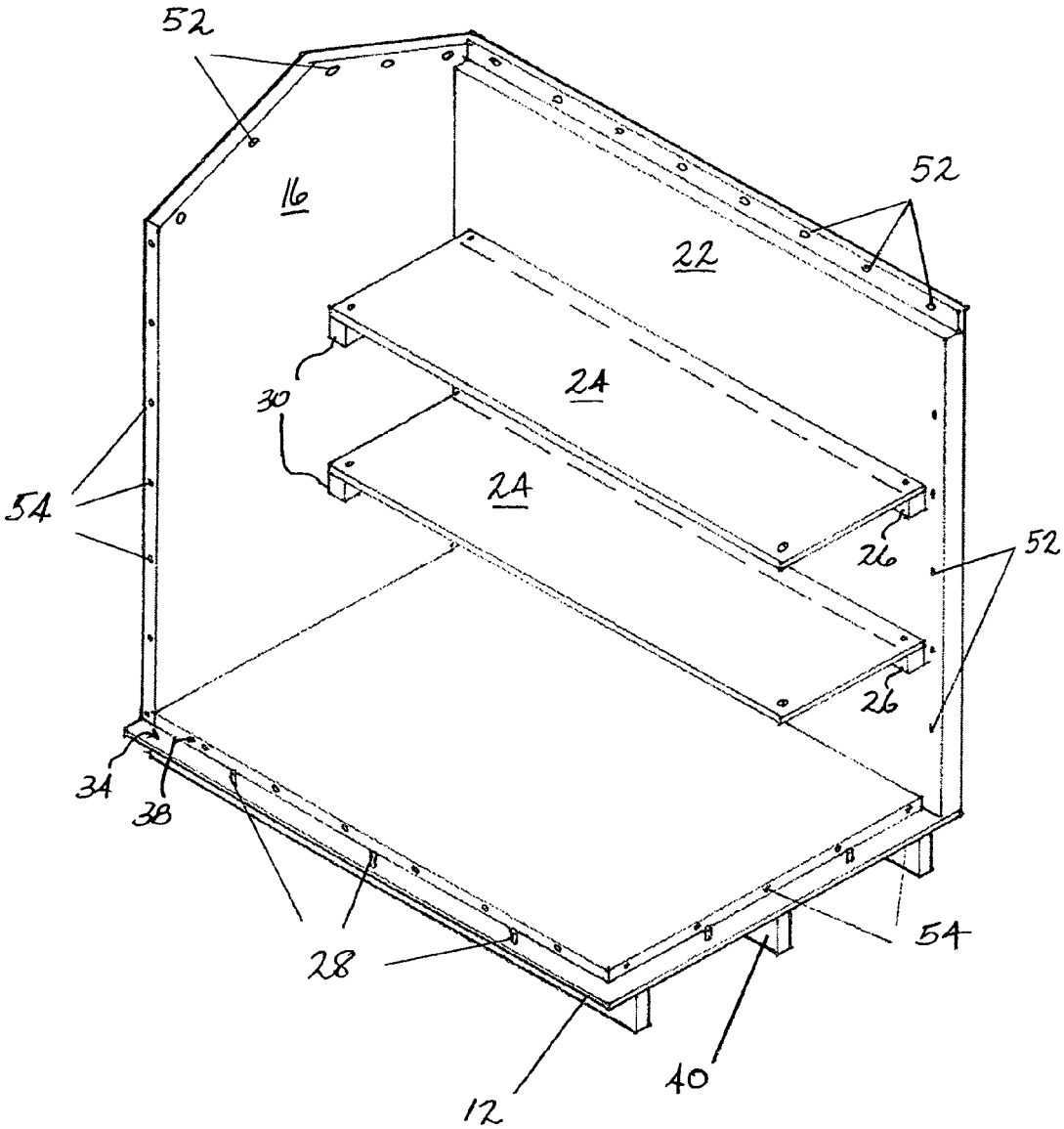
FIG. 2 is a perspective line drawing of the emergency shelter of FIG. 1 as if the roof and front and near sidewalls were removed illustrating interior features.

Referring to FIGS. 1 and 2, a housing unit assembled for use as an emergency shelter is illustrated generally at 10 in the present invention. The shelter is comprised of a front wall panel 18, two sidewall panels 14 and 16 respectively, a back wall panel 22, a roof panel 20, two bed platform panels 24 and a lower platform panel 12 which serves as the interior floor. In a preferred embodiment, the floor panel 12 also serves as the top surface of a rugged pallet for transporting the other panel sub-assemblies. The platform panel 12 of this preferred embodiment has a horizontal upper surface and lower skid-like projections, or risers, 40, which extend laterally along the underside of floor panel 12. The ends of three lateral risers 40 are visible in FIGS. 1 and 2. The lateral risers 40 are useful as a pallet for the sub-assemblies and also serve to keep the emergency shelter above the ground and free from flowing water.

Each panel sub-assembly is manufactured from plasticized polymeric panels of dual wall construction. Essentially these are plastic panels of dual wall construction having a hollow area contained within an outer plastic shell. In some constructions, the shell can have multiple layers. The hollow region between the outer shell(s) is filled with insulation or other composite material. Insulation such as cellular foam is sandwiched between the external polymeric shells to limit the effects of climatic temperature extremes. The rigid foam or other internally contained composite material acts as the medium to accept secure engagement with the aforementioned push anchors 50. The shelter illustrated in these FIGS. is approximately 2 meters (7 feet) wide, side wall 14 to side wall 16, and 1.6 meters (5 feet) deep measured from the front door panel 18 to the back wall panel 22. It is designed with a minimum inside ceiling height of approximately 1930 mm (6 ft. 4") and increases to more than 2200 mm (more than 7 feet) in the center of the structure. Thus it is able to provide comfortable accommodation to the vast majority of humans regardless of physical stature.

The front wall panel 18 contains within it a conventional door for ingress and egress and a window, suitably insulated, to supply light and ventilation which makes the inventive shelter more user-friendly and secure than tents commonly provided to refugees. A series of clearance holes 52 are molded into the panel to accommodate push anchors 50. The holes 52 project perpendicularly through the thickness of the panel and are located near the edge of the front surface, or face, of panel 18. Each hole 52 is slightly inset from the perimeter of panel 18 as they are designed to align with holes 54 in the edge faces of panels abutting the back surface of front panel 18. Hole 52, as mentioned, is a clearance hole for a push anchor whereas hole 54 is an acceptance hole for a push anchor. As such, hole 54 is a cavity within material designed to engage the pivoting members of the push anchor 50 as taught in U.S. Pat. Nos. 4,963,051 and 5,088,851. To simplify the assembly of the emergency shelter, all the push anchor 50 fasteners should be of the same size, in both diameter and length.

The back wall panel 22 supports two horizontal cleats 26 which provide partial support for the bed or sleeping platforms 24. Two such platforms 24, an upper and a lower, are provided with each shelter. A novel aspect of the inventive shelter is the structural support provided by the sleeping platforms 24 as they are fixed in position using push anchors 50 on outwardly molded cleats, or projections, 30 from each interior sidewall 14 and 16. The platforms 24 span the entire width of the shelter and therefore, as a person reclines on a horizontal platform 24, the down force imparted by his or her weight is transferred directly to the sidewalls 14 and 16 increasing the rigidity of the lightweight structure and thus enhancing its stability. The back wall panel 22, like front panel 18, has holes 52 to accommodate push anchors 50 located linearly around the surface of the panel near its perimeter. Alternatively, the bed or sleeping platforms 24, if extended in length, could be inset into the sidewalls 14,16 if a relief is provided in the sidewall to accept the additional length. Push anchors 50 can still be used to maintain the bed platforms fixedly against the sidewalls and back wall.

Each sidewall panel, as shown by numerals 14 and 16 in the various Figures, contains a surface projection 30 designed as a cleat or support for the end of a bed platform 24. These cleats contain a hole 54 suitably sized for acceptance and engagement of a push anchor 50. In addition, the sidewall panels 14 and 16, like the front panel 18 and back panel 22, have thru holes 52 to accommodate push anchors 50 located linearly around the surface of each respective panel near each of the panel perimeters.

Each bed platform 24 has one or more thru holes 52 on each end perpendicular to its top horizontal surface, suitably located to align with the push anchor acceptance holes 54 in the cleats 30 located on the sidewall panels 14, 16.

A roof panel 20 is delivered with the other sub-assemblies as a flat rectangular panel (not shown as flat) with protruding flanges 44 approximately 3" (7.6 cm.) high and 2" (5 cm.) in thickness. A view of a part of one protruding flange 44 is shown in FIG. 3. A relieved midline bend line 48 is molded into the plastic roof panel 20 allowing it to bend downward. As a result, the roof can rest on the top edges of the four vertical walls 14,16,18,22 bringing holes 54 in line with holes 52. Holes 54 are located in a line in flanges 44 which protrude from the underside of the roof 20; holes 52 are located in a line near the top edges of the vertical wall panels 14,16,18,22 as disclosed previously. The rapid assembly of the inventive emergency shelter 10 is possible because the parts are lightweight and capable of being assembled using a single size of push anchor 50. The method of rapid assembly is as follows: The sub-assemblies are delivered to the shelter erection site stacked on the floor platform 12 which is placed in a desired location. The back panel assembly 22 is removed from the stack and tilted into a vertical position along a longer side of the floor platform 12. The floor platform 12 has a horizontally relieved surface 34 along its perimeter; in this example, the width of the relieved surface 34 is the thickness of a vertical panel—3" (7.6 cm.). The depth of the relief is 2" (5 cm.). As a result, there is a secondary horizontal surface 34 3" wide adjacent a 1" (2.54 cm) high vertical face 38 along the entire perimeter of the floor platform 12. Locating pins 28 project vertically up from this secondary horizontal surface 34. These pins 28 are designed to mate with holes (not shown) in the bottom edge of each panel as each is raised and tilted into vertical position along the floor platform 12. When the back panel 22 is located on the pins 28 and held vertically, all the holes 52 along that side align with all the holes 54 in the vertical face 38 of the floor platform 12. Push anchors 50 are inserted passing through holes 52 into holes 54 and are pressed in permanently, locking the back panel 22 against the floor panel 12. Then, sequentially, a first sidewall panel, 14 or 16, is mounted on its respective locating pins 28 and tilted into vertical position and fastened in place. It is mated with the adjacent back wall panel along its vertical edge in the same manner as previously described by lining up holes 52 and 54 and inserting and fully depressing the push anchors 50. Then the second sidewall panel is erected and fastened in place. Then, with two sidewalls and the back wall fixed in place, the bed platforms 24 are mounted on cleats 30 and fastened to the inside wall panels using push anchors 50. Next, the front wall panel 18 is tilted into vertical position and fastened to the floor panel 12 and both sidewalls 14,16. Finally, the roof panel 20 is lifted into position over the tops of the vertical panels and fastened to each vertical panel 14,16,18,22 using push anchors 50. The push anchors are inserted through holes 52 in the vertical panels. The shank of the push anchor passes through holes 52 into holes 54 in the flanges 44 as shown in FIG. 3 which project downward from the underside of the roof panel 20.

Another embodiment of the emergency shelter provides the additional feature of solar cells in arrays on the roof panel 20 (not specifically illustrated in Figures provided) for harvesting solar energy for use directly or indirectly to supply electrical current for lighting or to augment current required for floor heating apparatus. These arrays of solar cells supply electricity where none is available or increase the available supply of electricity to occupants of the shelter when the supply is limited.

A further embodiment of the emergency shelter for use where colder temperatures are prevalent provides heating means embedded in the lower platform panel 12 preferably in the floor immediately below and in front of the bed platforms 24. An appropriate heating apparatus is shown in U.S. Pat. No. 4,922,084 which discloses a uni-directional device which would efficiently direct heat upwards into the interior of the emergency shelter. This device would also work in conjunction with the solar cells already mentioned.

The emergency shelter invention described is meant to be useful for a limited time, perhaps six months at most. As such it is desirable that it be made from fully recyclable materials.

In instances where wind or stormy weather will impart lateral forces against the paneled structure, the use of rope tethers or a weighted fabric skirt fastened to the outer panels will inhibit wind damage and keep the structure firmly in place. The embodiment illustrated in FIGS. 1 and 2 can use risers 40 manufactured of formed plastic which are hollow. Water can be injected to provide ballast and further retard movement by wind forces.

The emergency shelter as described weighs approximately 150 kg and thus can be easily air-dropped singly or in multiples. In a further embodiment, an air bladder is provided to act as a drop cushion fastened to the package containing the emergency shelters. As it exits the plane, the bladder is expanded to cushion the impact of the package as it hits the ground. The bladder, in collapsed form, can then be removed, fastened to the side panels or lower platform of the emergency shelter to act as the skirt noted above.

While the present invention has been disclosed and described herein with reference to certain embodiments, variations and modifications may be made which will fall into the true spirit and scope of the invention as defined in the following claims:

I claim:

1. A method for assembling an emergency shelter at a shelter erection site by two persons without tools in twenty minutes or less comprising the steps of:

A. removing a back panel subassembly from a stack of polymeric panel subassemblies comprised of a floor panel subassembly, having primary and secondary surfaces, two side panel subassemblies, a back panel subassembly, a front panel subassembly, a roof subassembly, one or more bed platform subassemblies, and a plurality of push anchors, B. locating said back panel along a longer side of said floor panel, C. tilting and raising said back panel into vertical position on said secondary surface of said floor panel over locating pins aligning thereby pre-formed holes in said back panel with pre-formed holes in said floor panel for reception of push anchors, D. inserting and fully depressing push anchors through pre-formed holes in said back panel into said floor panel causing full expansion of said push anchors thereby drawing surfaces of said polymeric panels into intimate contact and fixing said back panel in vertical position, E. tilting and raising a first side panel into vertical position and fastening with push anchors in the manner prescribed in D. above, F. mating said first side panel using said push anchors with said back panel along their adjacent vertical edges, G. tilting and raising a second side panel into vertical position and fastening with push anchors in the manner prescribed in D. above, H. installing one or more bed platform subassemblies in horizontal position fixedly fastening said bed platforms to said first and second side panels and to said back panel using push anchors in the manner prescribed in D. above, I. tilting and raising a front wall panel into vertical position and mating said front wall panel with said first and second side panels using push anchors along their respective adjacent vertical edges, J. lifting said roof panel into position over the tops of the vertical panel subassemblies such that flanges projecting downward from said roof panel lie adjacent the vertical panel subassemblies, and inserting push anchors through aligned pre-formed holes attaching roof panel to said vertical panel subassemblies.

2. A method for assembling an emergency shelter at a shelter erection site by two persons without tools in twenty minutes or less comprising the steps of:

A. removing selectively a front panel subassembly from a stack of polymeric panel subassemblies, comprised of a floor panel subassembly, having primary and secondary surfaces, two side panel subassemblies, a back panel subassembly, a front panel subassembly, a roof subassembly, one or more bed platform subassemblies, and a plurality of push anchors, B. locating said front panel along a longer side of said floor panel, C. tilting and raising said front panel into vertical position on said secondary surface of said floor panel over locating pins aligning thereby pre-formed holes in said front panel with pre-formed holes in said floor panel for reception of push anchors, D. inserting and fully depressing push anchors through pre-formed holes in said front panel into said floor panel causing full expansion of said push anchors thereby drawing surfaces of said polymeric panels into intimate contact and fixing said front panel in vertical position, E. tilting and raising a first side panel into vertical position and fastening with push anchors in the manner prescribed in D. above, F. mating said first side panel using said push anchors with said front panel along their adjacent vertical edges, G. tilting and raising a second side panel into vertical position and fastening with push anchors in the manner prescribed in D. above, H. installing one or more bed platform subassemblies in horizontal position fixedly fastening said bed platforms to said first and second side panels and to said back panel using push anchors in the manner prescribed in D. above, I. tilting and raising a back wall panel into vertical position and mating said back wall panel with said first and second side panels using push anchors along their respective adjacent vertical edges, J. lifting said roof panel into position over the tops of the vertical panel subassemblies such that flanges projecting downward from said roof panel lie adjacent the vertical panel subassemblies, and inserting push anchors through aligned pre-formed holes attaching roof panel to said vertical panel subassemblies.

3. A method for assembling an emergency shelter for human habitation at a shelter erection site by two persons without tools in ten minutes or less comprising the steps of:

A. removing a front or back panel subassembly from a stack of plasticized hollow filled polymeric panel subassemblies comprised of a floor panel subassembly, having primary and secondary surfaces, two side panel subassemblies, a back panel subassembly, a front panel subassembly, a roof subassembly, one or more bed platform subassemblies, and a plurality of push anchors, B. locating said front or back panel along a longer side of said floor panel, C. tilting and raising said front or back panel into vertical position on said secondary surface of said floor panel over locating pins aligning thereby pre-formed holes in said front or back panel with pre-formed holes in said floor panel for reception of push anchors, D. inserting and fully depressing push anchors through pre-formed holes in said front or back panel into said floor panel causing full expansion of said push anchors thereby drawing surfaces of said polymeric panels into intimate contact and fixing said front or back panel in vertical position, E. tilting and raising a first side panel into vertical position and fastening with push anchors in the manner prescribed in D. above, F. mating said first side panel using said push anchors with said front or back panel along their adjacent vertical edges, G. tilting and raising a second side panel into vertical position and fastening with push anchors in the manner prescribed in D. above, H. installing one or more bed platform subassemblies in horizontal position fixedly fastening said bed platforms to said first and second side panels and to said back panel using push anchors in the manner prescribed in D. above, I. tilting and raising a front wall panel into vertical position and mating said front wall panel with said first and second side panels using push anchors along their respective adjacent vertical edges, J. lifting said roof panel into position over the tops of the vertical panel subassemblies such that flanges projecting downward from said roof panel lie adjacent the vertical panel subassemblies, and inserting push anchors through aligned pre-formed holes attaching roof panel to said vertical panel subassemblies.

* * * * *